US006360488B1

(12) United States Patent
Darling

(10) Patent No.: US 6,360,488 B1
(45) Date of Patent: Mar. 26, 2002

(54) FOOT OPERATED DOOR OPENER

(76) Inventor: Garritt A. Darling, 9035 SE Bobwhite St., Hobe Sound, FL (US) 33455

( * ) Notice: Subject to any disclaimer, the term of this patent is extended or adjusted under 35 U.S.C. 154(b) by 0 days.

(21) Appl. No.: 09/723,533

(22) Filed: Nov. 27, 2000

(51) Int. Cl.[7] ..... E05F 13/04
(52) U.S. Cl. ..... 49/274
(58) Field of Search ..... 49/263, 404, 264, 49/266, 273, 274

(56) References Cited

U.S. PATENT DOCUMENTS 1,800,635 A * 4/1931 Isenberg et al. ..... 49/266
3,660,939 A * 5/1972 Suita ..... 49/263
5,469,661 A * 11/1995 Finkelstein
5,622,416 A * 4/1997 Rainey et al. ..... 49/263

* cited by examiner

*Primary Examiner*—Jerry Redman
(74) *Attorney, Agent, or Firm*—McHale & Slavin

(57) ABSTRACT

A foot operated door opener is formed as a triangular frame. The frame has an angular apex joint opposite the longer leg. The apex has an axle therethrough which is rotatably connected to a wall adjacent a sliding door. Pressure on the end of one leg of the frame causes rotation of the frame about the axle. The rotation causes another end of the frame to engage the sliding door and move it laterally to partially open the door.

12 Claims, 2 Drawing Sheets

FOOT OPERATED DOOR OPENER

FIELD OF THE INVENTION

This invention relates to the building field and to devices that can assist people, with or without handicaps, in gaining ingress and egress from buildings. This invention is directed, particularly, toward adding a mechanical advantage and ease of operation to a person's effort in opening sliding doors.

BACKGROUND OF THE INVENTION

Sliding doors are conventionally used in many applications as both interior and exterior doors. Usually these doors are referred to as pocket doors when mounted inside partitions between rooms. These doors may, indeed, slide on tracks laid on the floor or they may move on rollers in the bottom of the doors or tracks. Sometimes, they are hung from tracks mounted on the wall or ceiling connected to the top of the doors. In all applications, the sliding doors move horizontally parallel to a wall to open or close a door opening in the wall.

One of the more popular uses of the sliding door is in private homes and apartments as a glass exterior door, opening onto a deck or patio. The architectural and styling advantages of such doors are well known. However, either because of considerations of the doors moving in close proximity to each other or the wall or, simply, a sleeker style, the doors usually do not have any substantial handle for operation. In most cases, the doors have indentations that will accommodate the ends of the fingers. A person only has this small purchase to operate the door.

The operation of sliding doors is of no consequence to the young and fit with both hands free. But for those with weakened muscles, bone and joint problems, such as arthritis, such doors present a problem. Also, for everyone who tries to use a sliding door when their hands or arms are otherwise occupied with objects, the lack of a handle proves frustrating.

What is lacking in the prior art is a simple door opener that will operate a sliding door through use of the weight of the body, without the use of the hands, and adds mechanical advantage to the amount of force applied to the opener.

DESCRIPTION OF THE PRIOR ART

There are many foot operated door openers in the prior art however, the devices have not become popular consumer items. Such a situation usually results from the costs of the devices and/or the complexity of installation and reliability of use.

Representative of the prior art is U.S. Pat. No. 5,469,661 to Finkelstein et al, entitled, Sliding Door Foot Treadle. The disclosure is directed to opening refrigerator doors by a foot assist that moves the door in three dimensions. The treadle is an L-shaped lever mounted on the refrigerator by a bolt through the juncture of the legs of the L. One downwardly extending leg is positioned against the edge of the door and the other leg extends horizontally as the treadle. Stepping on the treadle rotates the downwardly extending leg against the edge of the door for opening the door. In this construction, the downwardly extending leg wears against the edge of the door. Further, the treadle leg and the operating leg must bear all the opening load on the unsupported ends of the legs which could lead to failure or bending of the either leg.

SUMMARY OF THE INVENTION

A foot operated door opener is formed as a triangular frame. The frame has an angular apex joint opposite the longer leg. The apex has an axle therethrough which is rotatably connected to a wall adjacent a sliding door. Pressure on the end of one leg of the frame causes rotation of the frame about the axle. The rotation causes another end of the frame to engage the sliding door and move it laterally to partially open the door.

Accordingly, it is an objective of the instant invention to teach a simple, easily installed foot operated door opener for applying a lateral force to a sliding door.

It is a further objective of the instant invention to teach a sliding door opener with a reinforced lever arms for withstanding repeated usage and large loads without failure.

It is yet another objective of the instant invention to teach a spring loaded door opener that automatically returns to a starting position upon release of foot pressure.

It is a still further objective of the invention teach the provision of a structure to convert arcuate movement to lateral movement and protect the integrity of the door.

Other objectives and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DETAILED DESCRIPTION OF THE INVENTION

Figure 1:
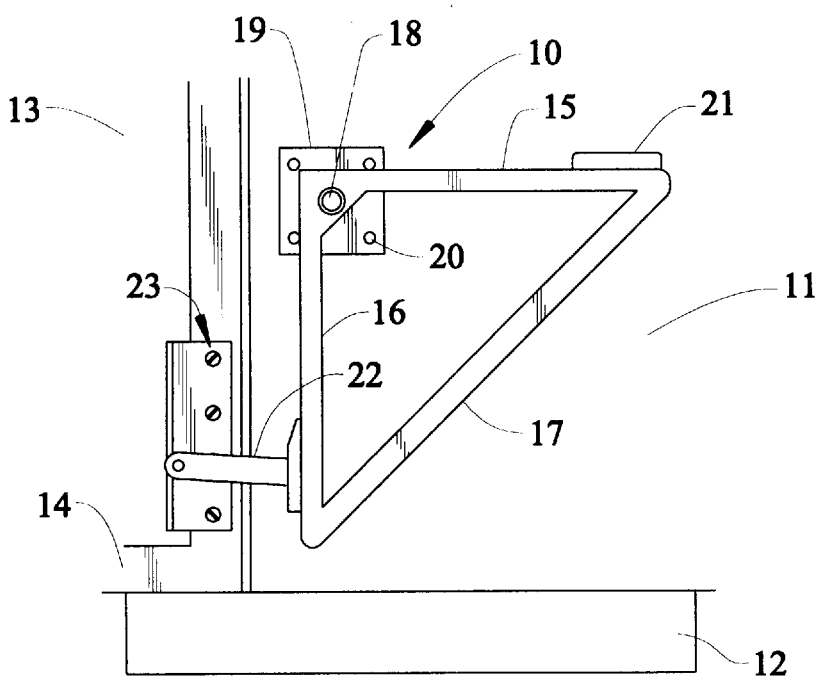
FIG. 1 shows a perspective of a mounted foot operated opener of this invention in the starting position.

The foot operated door opener 10 is mounted on a wall 11 adjacent an edge of a door 13. The bottom 14 of the door slides along the floor 12. The opener is formed as a planar triangular frame with a horizontal leg 15 and a downwardly extending leg 16 in the starting position. The horizontally and downwardly extending legs, each have one end connected to a longer leg 17. The plane of the triangular frame is parallel to the plane of the wall, as shown in FIG. 1. This triangular shape adds reinforcement to both the horizontal and downwardly extending legs.

The other ends of legs 15 and 16 are joined at an apex angle opposite the longer leg 17. An axle 18 extends through this joint normal to the plane of the opener. The axle 18 is rotatably fixed in a bracket 19 connected to the wall by screws 20. Other wall fasteners may be used, such as bolts, nails welding or adhesives. In some instances, the bracket 19 may be attached to the door frame adjacent to the door opening. In any event, the bracket is located a horizontal distance from the edge of the door to permit the leg 16 to extend into the door opening in the open position.

Figure 2:
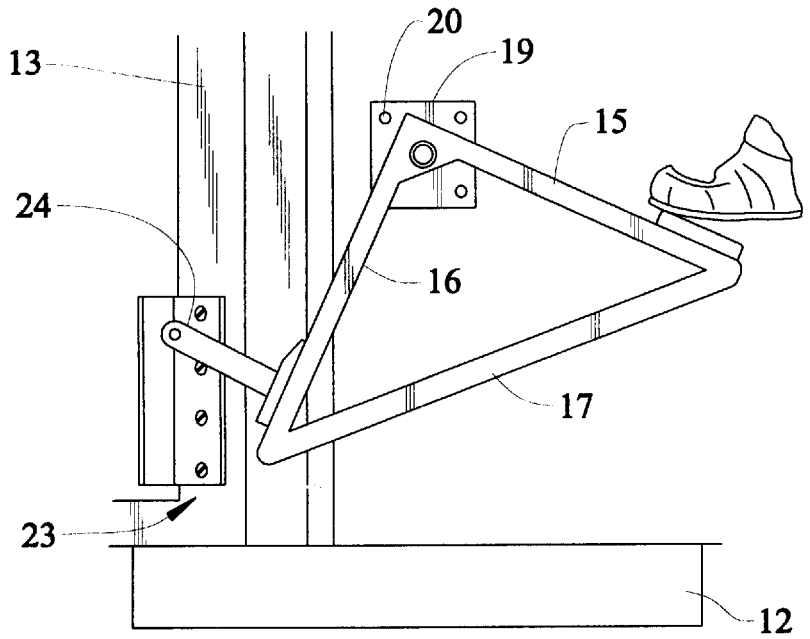
FIG. 2 shows a perspective of a mounted foot operated opener of FIG. 1 in the open position.

A pad 21 is located on leg 15 near the end which connects with the longer leg 17. This pad may take any form, such as an enlarged horizontally oriented plate, a roughened area of the leg 15 or a rubber pedal fixed on the leg. A plate or pedal may be connected to the leg 15 by screws, bolts, rivets or welding, as a matter of choice. This pedal forms the surface upon which a person may apply pressure to rotate the triangular frame. Normally, a user would step on this pedal and use hie or her weight to move the opener, as shown in FIG. 2. Other appendages or devices, such as canes and crutches, may be used to operate the pedal. Also, the opener 10 may be placed on the wall at locations other than the height above the floor shown in FIGS. 1 and 2. Because of the length of the legs, from the edge of the door to the foot pedal, there is a lever arm which adds mechanical advantage to the pressure applied to the pedal 21.

Figure 4:
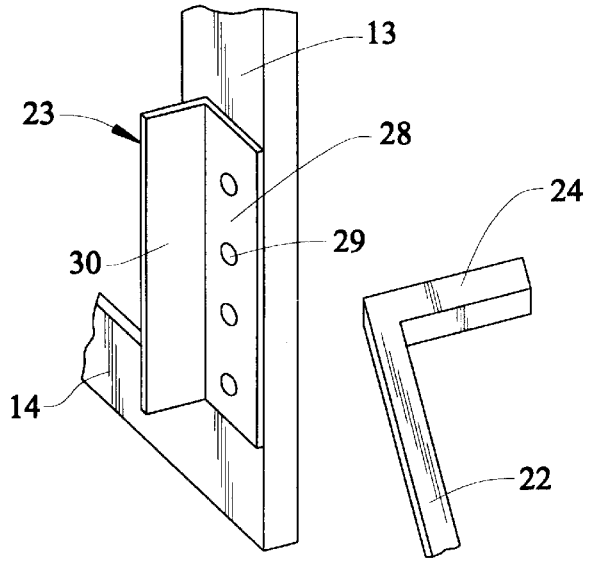
FIG. 4 shows a perspective of the actuator and strike plate.

A contact arm 22 is attached near the end of the downwardly extending leg 16 that is connected to the longer leg 17. The contact arm 22 extends generally horizontally from the triangular frame toward the edge of the door 13 in the same plane as the opener, in the starting position. The length of the contact arm corresponds to the distance between the bracket 19 and the door. When the bracket 19 is located adjacent to the door opening the contact arm may be omitted (not shown). The contact arm may be an integral portion of the triangular frame or it may be connected to the frame by screws or bolts or welding. The contact arm 22 has an actuator 24 which engages the door 13. As shown in FIGS. 2 and 4, the actuator 24 is perpendicular to the axis of the contact arm. The length of the actuator corresponds to the distance the triangular frame 10 is offset from the edge of the door.

Figure 3:
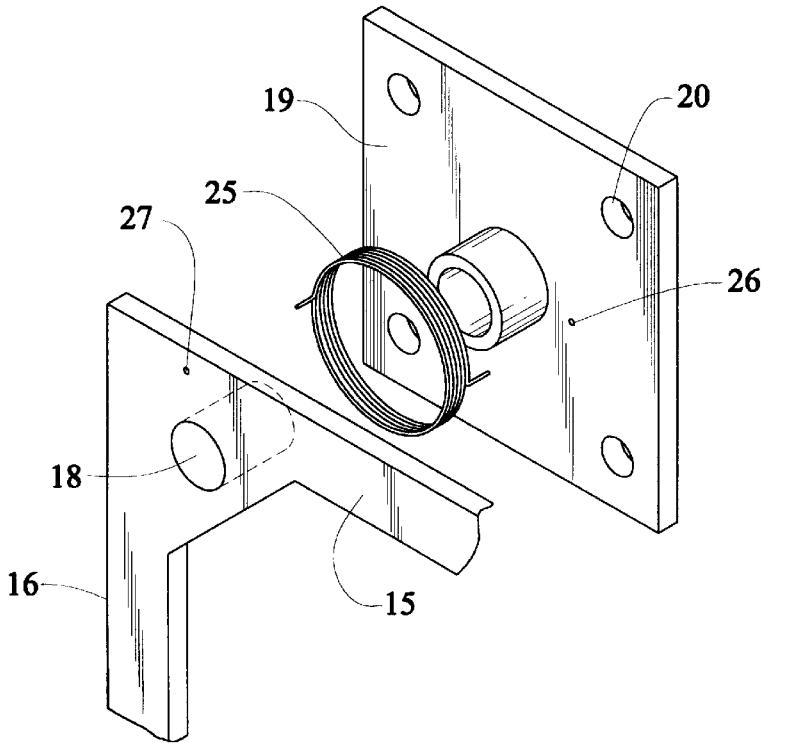
FIG. 3 shows an exploded view of the spring loaded axle.

The axle 18, as shown in FIG. 3, is spring loaded to return to the starting position after rotation to the open position. A coil spring 25 encircles the axle 18 with one end of the coil attached to the bracket 19 in aperture 26 and the other end connected to the triangular frame in aperture 27. When force is applied to the pedal 21, the opener rotates to the open position causing the spring to store torsional energy. When the force is removed the spring 25 unloads and returns the frame to the starting position. While a coil spring has been shown and described, other spring arrangements may be used, such as a cam and leaf.

A strike plate 23 is attached to the edge of the door 13. As shown in FIG. 4, the strike plate is L-shaped in cross section. It has two planar flanges 28 and 30 oriented normal to each other. Flange 28 is connected to the door 13 by screws 29 though other fasteners may be used. Flange 30 forms a planar surface normal to the plane of the door. The flange 30 is frictionally connected to actuator 24. As pressure is applied to pedal 21, contact arm 22 moves arcuately in response to the rotation of leg 16 about axle 18. The arcuate movement produce a lateral vector and a vertical vector in the movement of the actuator 24. The lateral vector causes the door to move along the floor and the vertical vector causes the actuator 24 to move upwardly along flange 30. Depending on the particular installation of the door and framing, the height of flange 30 may vary or be omitted.

In the open position, shown in FIG. 2, the edge of the door is spaced from the wall a sufficient distance to allow partial entry into the door opening. A user may use a hand, arm, leg or shoulder to gain purchase against the edge of the door to complete the opening of the door.

It is to be understood that while a certain form of the invention is illustrated, it is not to be limited to the specific form or arrangement of parts herein described and shown. It will be apparent to those skilled in the art that various changes may be made without departing from the scope of the invention and the invention is not to be considered limited to what is shown and described in the specification and drawings.

What is claimed is:

1. A foot operated door opener comprising a planar triangular frame having a first and second short legs and a longer leg, one end of each of said first and second short legs forming an angular joint at an apex opposite said longer leg, said frame having an axle extending perpendicularly through said joint normal to the plane of said planar triangular frame, said other end of said first short leg angularly fixed to one end of said longer leg, a foot pedal formed on said other end of said first short leg opposite said one end of said longer leg, said other end of said second short leg angularly fixed to the other end of said longer leg, a contact arm having one end mounted on said other end of said second short leg opposite said other end of said longer leg and extending outwardly from said other end of said second short leg in the same plane as said triangular frame, said contact arm having an actuator on the other end, said actuator perpendicularly fixed to said other end of said contact arm, said actuator and said axle extending in the same direction whereby said triangular frame has a rest position and is rotated about said axle by force applied to said foot pedal, said foot pedal and said actuator moving in an arcuate path about said axle, said actuator adapted to contact a sliding door and move said door a horizontal distance corresponding to said arcuate path.

2. A foot operated door opener of claim 1 wherein said axle includes a spring which resiliently stores energy by said force applied to said foot pedal and said arcuate movement, said spring releasing said stored energy and rotating said triangular frame to said rest position upon release of said force.

3. A foot operated door opener of claim 2 wherein said spring has two ends, one end of said spring attached to said bracket and the other end of said spring attached to said triangular frame.

4. A foot operated door opener of claim 1 wherein said axle is rotatably connected to a bracket, said bracket adapted to be attached to a wall adjacent to said door.

5. A foot operated door opener of claim 1 including an L-shaped strike plate having two planar flanges joined together along a common edge, the planar surface of one of said flanges adapted to the connected to a planar surface of a sliding door, the other flange extending perpendicularly from the said planar surface of said door.

6. A foot operated door opener of claim 5 wherein said actuator is adapted to contact said other flange of said strike plate.

7. In the combination of a door mounted for horizontal movement along a floor parallel to a wall with an edge for contacting a door frame in said wall and an improved door opener, the improvement comprising a planar triangular frame mounted parallel to said wall on an axle extending from said wall adjacent said edge of said door, said triangular frame having one leg extending from said axle toward said floor to a lower end, said triangular frame having another leg extending from said axle away from said edge of said door to a distal end, said triangular frame having an elongated leg with a first end joining said lower end of said one leg and a second end joining said distal end of said other leg, said elongated leg extending at an acute angle to said floor, said axle located on said wall a distance above said floor greater than the length of said one leg, said lower end of said one leg carrying an actuator for contacting said edge of said door, said distal end of said other leg carrying a pressure pad whereby when pressure is applied to said pressure pad said triangular frame will rotate about said axle and said actuator will engage said edge of said door and move said door in a horizontal direction away from said door frame.

8. The combination of claim 7 wherein said improved door opener includes a spring carried by said axle, said spring resiliently storing energy upon rotation of said triangular frame about said axle in response to said pressure, said spring resiliently releasing said energy and rotating said triangular frame about said axle upon release of said pressure.

9. The combination of claim 8 wherein said improved door opener includes a strike plate fixed to said door parallel to said edge of said door, said strike plate having an elongated planar flange extending normal to said door, said actuator frictionally engaging said flange and sliding along said planar flange as said triangular frame rotates about said axle in response to said pressure.

10. The combination of claim 9 wherein said improved door opener includes a bracket mounted on said wall adjacent said edge of said door, said bracket rotatably connected to said axle.

11. The combination of claim 10 wherein said spring has two ends, said bracket is connected to one end of said spring, and said triangular frame is connected to the other end of said spring.

12. The combination of claim 9 wherein said actuator has an extension arm connected at one end to a friction arm, said friction arm extending normal to said extension arm in a direction parallel to said axle, the other end of said extension arm connected to said lower end of said one leg of said triangular frame and oriented parallel to said wall.

* * * * *